US005126516A

United States Patent [19]

Thuries et al.

[11] Patent Number: 5,126,516

[45] Date of Patent: Jun. 30, 1992

[54] PUFFER-TYPE MEDIUM OR HIGH TENSION CIRCUIT BREAKER

[75] Inventors: Edmond Thuries, Meyzieu; Denis Dufournet, Bron; Michel Perret, Bourgoin-Jallieu, all of France

[73] Assignee: GEC Alsthom SA, Paris, France

[21] Appl. No.: 651,155

[22] Filed: Feb. 6, 1991

[30] Foreign Application Priority Data

Feb. 7, 1990 [FR] France ..... 90 01406

[51] Int. Cl.[5] ..... H01H 33/82

[52] U.S. Cl. ..... 200/148 A; 200/148 B

[58] Field of Search ..... 200/148 A, 148 B, 148 R

[56] References Cited

FOREIGN PATENT DOCUMENTS 0041081 12/1981 European Pat. Off. .
0175954 4/1986 European Pat. Off. .
0315505 5/1989 European Pat. Off. .

*Primary Examiner*—Harold Broome

*Attorney, Agent, or Firm*—Sughrue, Mion, Zinn, Macpeak & Seas

[57] ABSTRACT

A medium or high tension arc-puffing circuit breaker comprising a gastight casing filled with a dielectric gas and containing a semi-fixed first contact electrically connected to a first current terminal and a moving second contact which is electrically connected to a second current terminal and which is mechanically connected to a drive member, said semi-fixed contact being fixed to a piston that moves in a cylinder, said piston delimiting a first volume in the arc zone end of said cylinder and a second volume in the other end thereof, said semi-fixed contact being subject to the action of a spring urging the semi-fixed contact in the same direction as the moving contact during a disengagement operation, wherein the circuit breaker includes means for limiting the speed and the amplitude of the motion of the piston in the spring-compressing direction during a disengagement operation on a short circuit current, said means also enabling unpolluted gas to be injected into the arcing contact zone during the reengagement operation that follows said disengagement operation.

4 Claims, 4 Drawing Sheets

PUFFER-TYPE MEDIUM OR HIGH TENSION CIRCUIT BREAKER

The present invention relates to a medium or high tension circuit breaker in which insulation is provided by a gas having good dielectric properties, such as sulfur hexafluoride ($SF_6$), which gas is also puffed to extinguish the arc that is formed when the arcing contacts of the circuit breaker separate.

BACKGROUND OF THE INVENTION

In this type of apparatus, there is a volume referred to as the "thermal" volume or the "blast" volume which contains the arcing contacts and which, when the contacts separate, is heated by the arc, thereby causing the pressure in said volume to increase. At the first zero crossing of the current, the gas expands and blasts the arc.

The following difficulties are known to arise when implementing an apparatus of this type:

When interrupting low value currents (e.g. a current that is less than or equal to the nominal current normally carried by the circuit breaker), the rise in pressure may be too small or too large, depending on the size of the blast volume. If the blast volume is large in size, then the pressure rise is small and the blast may be insufficient. If the blast volume is small, then the pressure rise is large, but the duration of the blast may be too short for good efficiency.

In contrast, when interrupting high currents (e.g. short circuit currents), the pressure rise and the heating up of the gas must not be too large since that could prevent interruption taking place.

In order to solve this problem, proposals have been made, in particular in Document EP-A-0 315 505, to provide a blast volume in the form of an interrupting chamber whose volume is variable depending on the value of the current to be interrupted.

This is achieved by replacing the fixed arcing contact conventionally to be found in circuit breakers with a semi-fixed contact linked to a piston which is subject to thrust from an opposing spring.

The stroke of the piston varies according to the value of the current to be interrupted, thereby causing a corresponding variation in the size of the blast volume.

Such apparatus suffers from a drawback.

When interrupting high value currents, the semi-fixed contact rises quickly and completely, with the spring having no limiting effect, thereby causing the arc to be lengthened excessively, which in turn has the effect of heating the blast gas too much, thereby running the dangers of spoiling the interrupting dielectric, of excessively polluting the medium surrounding the arc, and possibly of causing the second interruption to fail during open-0.3s pause-close-open cycles.

A first object of the invention is to enable high currents to be interrupted by puffing using thermal expansion in a thermal expansion volume having the appropriate size for this purpose, while also enabling low currents to be interrupted by puffing, but using only a portion of the thermal full expansion volume.

A second object of the invention is to provide apparatus in which the upwards speed and stroke of the semi-fixed assembly are limited progressively.

A third object of the invention is to provide an apparatus in which cool gas is injected into the arcing contact zone during an engagement operation, thereby considerably improving the operation of the apparatus during operating cycles of the type mentioned above.

SUMMARY OF THE INVENTION

These objects are achieved by the present invention which provides a medium or high tension arc-puffing circuit breaker comprising a gastight casing filled with a dielectric gas and containing a semi-fixed first contact electrically connected to a first current terminal and a moving second contact which is electrically connected to a second current terminal and which is mechanically connected to a drive member, said semi-fixed contact being fixed to a piston that moves in a cylinder, said piston delimiting a first volume in the arc zone end of said cylinder and a second volume in the other end thereof, said semi-fixed contact being subject to the action of a spring urging the semi-fixed contact in the same direction as the moving contact during a disengagement operation, wherein the circuit breaker includes means for limiting the speed and the amplitude of the motion of the piston in the spring-compressing direction during a disengagement operation on a short circuit current, said means also enabling unpolluted gas to be injected into the arcing contact zone during the reengagement operation that follows said disengagement operation.

In a particular embodiment, said means comprise members for closing said second volume during a disengagement operation, said members enabling gas to pass from said second volume into said first volume during a reengagement operation.

For example, said members may comprise firstly first holes passing through said piston and closable by means of first non-return valves which are closed when the pressure in said first volume is greater than the pressure in said second volume, and secondly second holes passing through the end of said cylinder and closable by second non-return valves which are closed when the pressure in said second volume is greater than the pressure in the casing outside said cylinder.

Advantageously, said first non-return valves are together constituted by a first washer.

Similarly, said second non-return valves may together be constituted by a second washer.

BRIEF DESCRIPTION OF THE DRAWINGS

An embodiment of the invention is described by way of example with reference to the accompanying drawings, in which.

DETAILED DESCRIPTION

Figure 1:
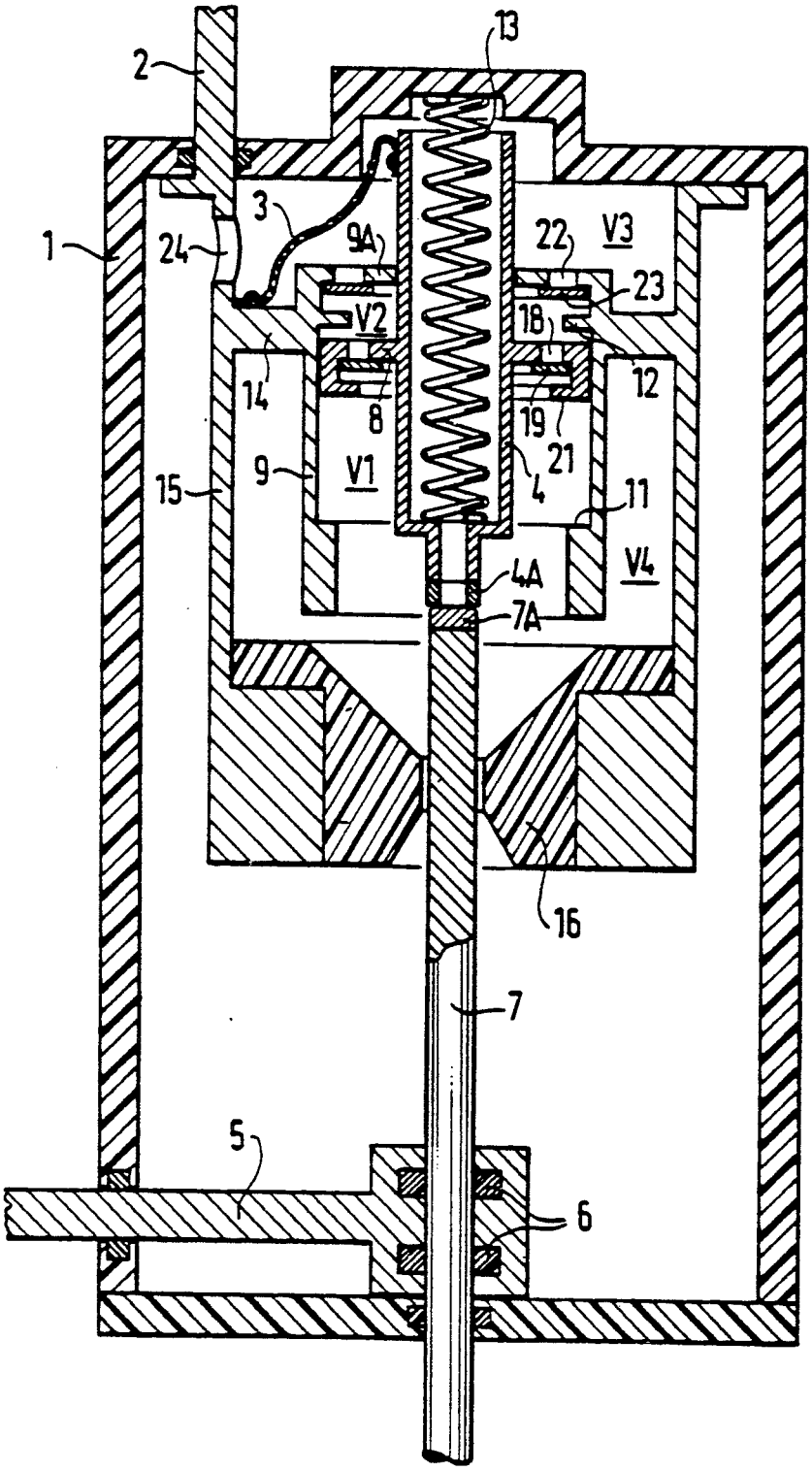
FIG. 1 is an axial section view of a circuit breaker of the invention shown in the engaged position.

In FIG. 1, there can be seen a casing 1 of insulating material containing a gas having good dielectric properties such as sulfur hexafluoride $SF_6$ at a pressure of 1 to a few bars. A first current terminal 2 passes through the casing in sealed manner and is electrically connected by a braid 3 to a first contact 4 which is referred to as being "semi-fixed" for reasons explained below. The contact 4 is tubular in shape and is terminated by a wear piece 4A made of a material which withstands the effect of electric arcing, e.g. made of an alloy based on tungsten.

A second current terminal 5 passes through the casing in sealed manner and is electrically connected via sliding contacts 6 to a rod 7 which constitutes a moving contact of the circuit breaker. The rod 7 passes through the casing in sealed manner and is connected to a drive mechanism (not shown). The rod 7 has an end 7A made of a material which withstands the effects of electric arcing.

The semi-fixed contact 4 carries a piston 8 slidably received in a fixed cylinder 9. The stroke of the piston 8 is limited by a bottom shoulder 11 and by a top ring 12. The semi-fixed contact 4 has a spring 13 bearing thereagainst, which spring is compressed when the circuit breaker is in the engaged position, as shown in FIG. 1.

The cylinder 9 is fixed via a closed end 14 to a cylinder 15 of larger dimensions. The larger cylinder 15 is fixed to the casing 1 and it carries an insulating nozzle 16 at one end with the rod 7 sliding therethrough.

The piston 8 divides the inside of the cylinder 9 into two volumes, a first volume V1 constituting a bottom volume in the figure and a second volume V2 constituting a top volume. The volumes V1 and V2 can communicate via orifices 18 formed through the piston 8. These orifices are suitable for being closed simultaneously by a non-return valve constituted by a washer 19 which is retained by a shoulder 21 of the piston 8. The second volume V2 can communicate with the volume V3 outside the cylinder 9 via orifices 22 formed through the closed end 14 thereof. These orifices are suitable for being closed simultaneously by a non-return valve constituted by a washer 23 retained by the ring 12.

Orifices 24 formed through the cylinder 15 facilitate the flow of gas inside the casing 1.

The volume lying between the cylinders 15 and 9 is designated V4 and is in permanent communication with the volume V1 via a passage between the nozzle 16 and the end of the cylinder 9, such that the volumes V4 and V1 taken together constitute a total thermal expansion volume V1+V4 for the circuit breaker.

The operation of the circuit breaker is now described.

Interrupting Low Currents

These are currents of a value no greater than the nominal current of the line phase in which the circuit breaker is inserted.

The rod 7 is pulled downwards in the figure by the drive mechanism. The semi-fixed contact 4 under thrust from the spring 13 accompanies the rod downwards until the piston 8 is stopped by the shoulder 11. The rod then continues to move down on its own, thereby separating the contacts. An arc 50 is struck between the contacts (FIG. 2) and heats the surrounding gas. The increase in pressure generated by the downwards displacement of the piston 8 and by heating the gas in the volumes V1 and V4 causes the arc to be blasted through the nozzle 16 and the contact 4A, with the arc being extinguished when the current passes through zero.

During this operation, the slight reduction in the pressure in the volume V1 thrusts the non-return valve 19 against its seat, thereby isolating the volume V2.

Interrupting High Value Currents

These are short circuit currents.

Until the contacts separate the process begins in identical manner to that described above.

Figure 3:
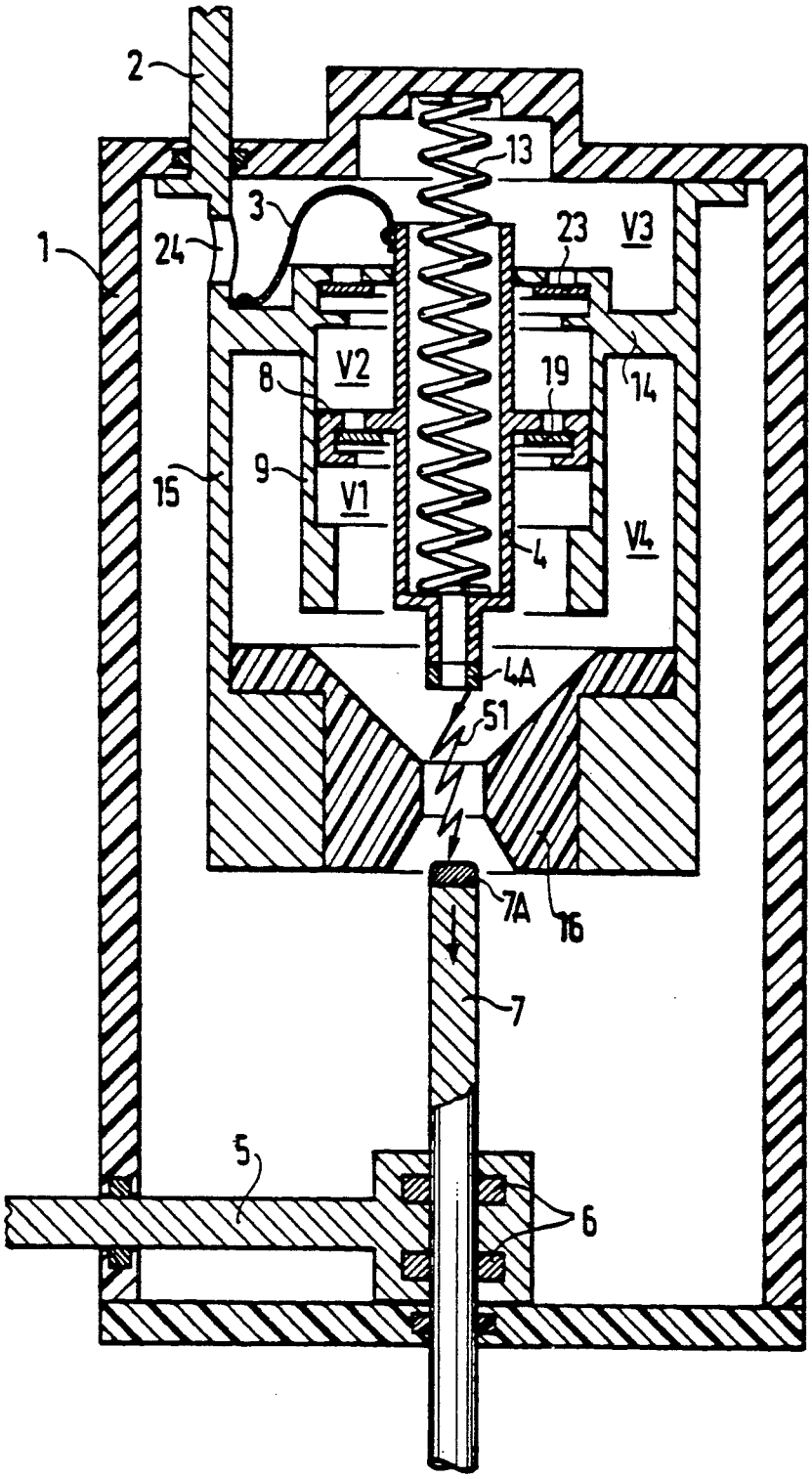
FIG. 3 is an axial section view of the same circuit breaker shown while disengaging on a short circuit.

However, in this case the arc 51 (FIG. 3) is very hot, giving off sufficient heat to cause the pressure in the volumes V1 and V4 to rise very considerably. The contact 4 is pushed back upwards in the figure because of the very large pressure exerted on the piston 8 and producing a force which overcomes that of the spring 13. The volume V1 is thus enlarged so that although the pressure therein is high it nevertheless remains at a value which is acceptable.

The increased pressure in the volume V1 causes the non-return valve 19 to close, thereby isolating the volume V2. This volume is reduced by the moving piston 8. As a result the pressure in the volume V2 increases, thereby firstly closing the non-return valve 23 and secondly limiting the speed and the stroke of the piston 8, with the gas in the volume V2 acting as shock absorbing means. As a result the arc 51 is not lengthened excessively, thereby limiting the amount of heat it gives off and the extent to which the surrounding gas is polluted by $SF_6$ decomposition products.

The pressure increase as generated essentially by thermal expansion inside the volumes V1 and V4 causes the arc to be blasted via the nozzle 16 and the contact 4A, with the arc being extinguished when the current passes through zero.

Figure 2:
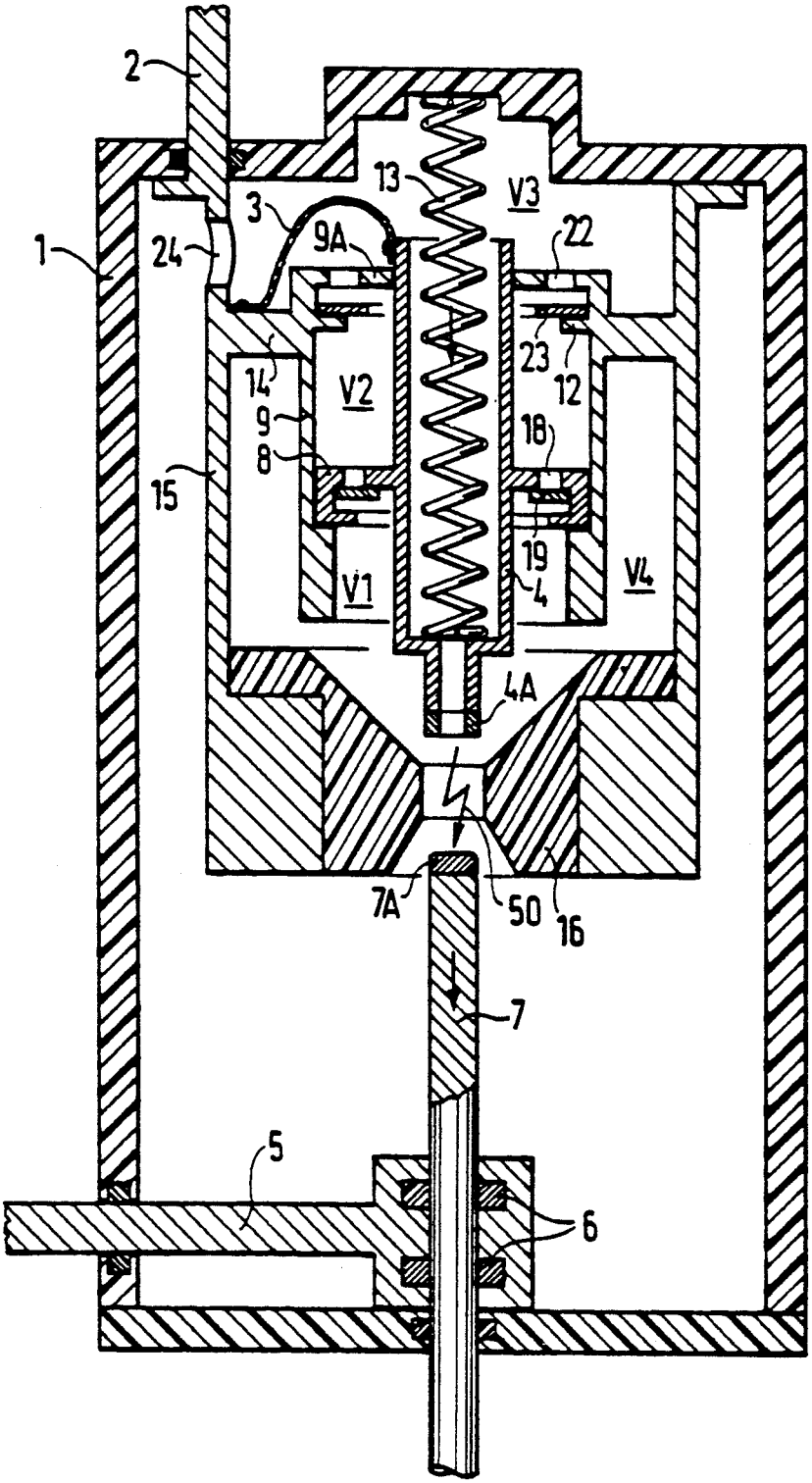
FIG. 2 is an axial section view of the same circuit breaker shown while disengaging on a low value current.

After the arc has been extinguished, the spring 13 returns the semi-fixed contact into abutment against the shoulder 1 as shown in FIG. 2.

Reengagement

Figure 4:
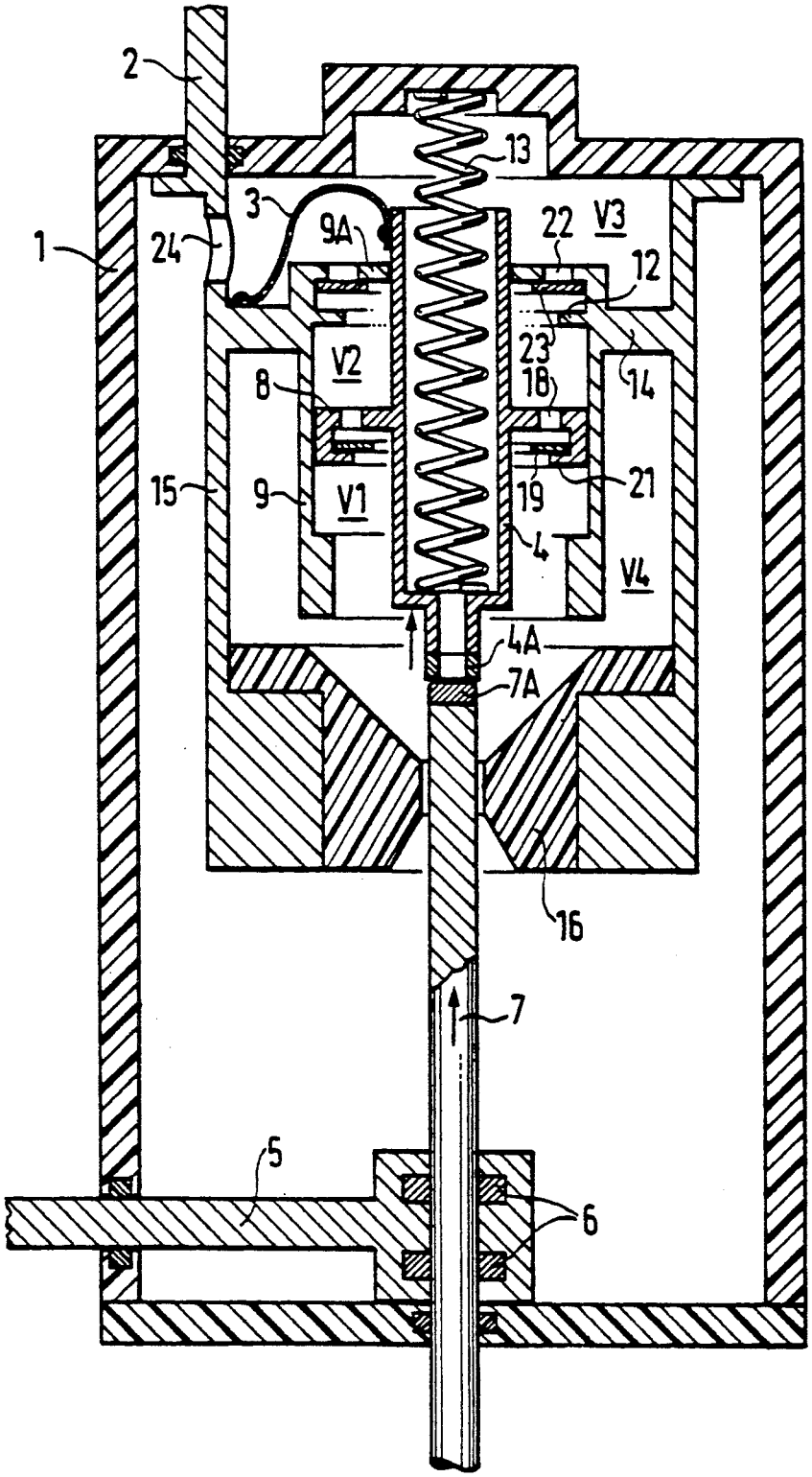
FIG. 4 is an axial section view of the same circuit breaker shown during an engagement operation.

When the circuit breaker is reengaged by displacing the rod 7 upwards in the figure (see FIG. 4), the pressure in the volume V1 is reduced, thereby opening the non-return valve 19. Unpolluted gas from the volume V2 then passes through the orifices 18, thereby improving the dielectric quality of the gas in the volumes V1 and V2, thus improving the chances of success of any circuit-breaking operation that may take place a short time after reengagement (as in an open, 0.3 second pause, close, open cycle).

The invention is not limited to the embodiment described by way of example, and applies to any circuit breaker in which the means of the invention are replaced by means performing the same functions for obtaining the same results.

The invention is applicable to medium and high tension circuit breakers.

We claim:

1. A medium or high voltage arc-puffing circuit breaker comprising: a gastight casing filled with a dielectric gas, a drive member extending through said casing, said gastight casing containing a semi-fixed, first contact electrically connected to a first current terminal carried by said casing and a movable, second contact which is electrically connected to a second current terminal and being mechanically connected to said drive member, said semi-fixed contact being fixed to a piston movably mounted in a first cylinder internally of said casing, said piston delimiting on opposite sides thereof in said first cylinder a first volume and a second volume, said first cylinder being closed at a first end and open at a second end thereof, said first volume being open at said second end, a spring carried by said casing and biasing the semi-fixed contact in a direction of movement of the movable contact during a disengagement operation of said semi-fixed contact and said movable contact, said first cylinder being surrounded by a second coaxial cylinder fixed both to said first cylinder and to said casing and terminated by an insulating nozzle, means mounting said drive member for passage through said nozzle aligned with said semi-fixed, first contact and abuttable therewith, said second cylinder defining with said first cylinder first end and with said casing a third volume, said second cylinder defining with said first cylinder and said insulating nozzle a fourth volume, said third volume communicating by means of at least one aperture with a fifth volume formed between said second cylinder and said casing, said piston comprising at least one first hole closable by means of a first non-return valve which is closed when the pressure in the first volume is greater than the pressure in the second volume, said first end of said first cylinder comprising at least one second hole closable by means of a second non-return valve which is closed when the pressure in said second volume is greater than the pressure in said fifth volume.

2. A circuit breaker according to claim 1, wherein said first non-return valve is constituted by a first washer open to said first volume and movable to close off said at least one first hole.

3. A circuit breaker according to claim 1, wherein said second non-return valve is constituted by a second washer within said second volume and movable to close off said at least one second hole.

4. A circuit breaker according to claim 1, wherein said first volume is in continuous communication with a fourth volume via a passage between said nozzle and an open end of said cylinder.

* * * * *